US006370904B2

(12) United States Patent
Tchougounov et al.

(10) Patent No.: US 6,370,904 B2
(45) Date of Patent: Apr. 16, 2002

(54) ICE MAKER WITH IMPROVED HARVEST DETECTION AND THERMAL EFFICIENCY

(75) Inventors: Andrei Tchougounov, Ligonier; Robert G. Cox, Goshen; Donald E. DeWitt, Syracuse, all of IN (US)

(73) Assignee: Dekko Heating Technologies, North Webster, IN (US)

( * ) Notice: Subject to any disclaimer, the term of this patent is extended or adjusted under 35 U.S.C. 154(b) by 0 days.

(21) Appl. No.: 09/748,410

(22) Filed: Dec. 26, 2000

Related U.S. Application Data

(63) Continuation-in-part of application No. 09/499,011, filed on Feb. 4, 2000, now Pat. No. 6,223,550, which is a continuation-in-part of application No. 09/285,283, filed on Apr. 2, 1999, now Pat. No. 6,082,121.

(51) Int. Cl.[7] ..... F25C 1/12
(52) U.S. Cl. ..... 62/353
(58) Field of Search ..... 62/71, 353

(56) References Cited

U.S. PATENT DOCUMENTS

| | | | | | |
|---|---|---|---|---|---|
| 948,131 | A | | 2/1910 | Bull | 62/356 |
| 1,963,842 | A | | 6/1934 | Gay | 62/105 |
| 2,542,891 | A | * | 2/1951 | Bayston | 62/353 |
| 2,775,101 | A | | 12/1956 | Hanson | 62/356 |
| 3,196,624 | A | | 7/1965 | Reynolds | 62/71 |
| 3,274,792 | A | * | 9/1966 | Weil et al. | 62/354 |
| 3,654,772 | A | | 4/1972 | Curry, III | 62/353 |
| 3,678,701 | A | | 7/1972 | Powell et al. | 62/353 |
| 3,708,992 | A | | 1/1973 | Clearman et al. | 62/71 |
| 3,896,631 | A | | 7/1975 | Morrison | 62/71 |
| 3,984,996 | A | * | 10/1976 | Bright | 62/71 |
| 4,003,214 | A | | 1/1977 | Schumacher | 62/340 |
| 4,183,222 | A | | 1/1980 | Swanson | 62/71 |
| 4,355,522 | A | | 10/1982 | Gorski et al. | 62/340 |
| 4,429,543 | A | | 2/1984 | Fischer | 62/347 |
| 4,732,006 | A | * | 3/1988 | Fischer | 62/353 |
| 4,901,539 | A | | 2/1990 | Garber et al. | 62/356 |
| 5,167,132 | A | | 12/1992 | Meier | 62/356 |
| 6,101,817 | A | * | 8/2000 | Watt | 62/353 |

FOREIGN PATENT DOCUMENTS

| | | | |
|---|---|---|---|
| DE | 351706 | 3/1921 | 62/356 |

* cited by examiner

*Primary Examiner*—William E. Tapolcai
(74) *Attorney, Agent, or Firm*—Taylor & Aust, P.C.

(57) ABSTRACT

An ice maker includes a mold having at least one cavity configured for containing water therein for freezing into ice. An auger extends substantially vertically through the at least one mold cavity. The auger is configured for rotating to thereby push the ice out of the at least one mold cavity. A temperature sensor is positioned in association with the mold for sensing a temperature of the mold. A heat transfer member is metallurgically coupled with the auger and extends downwardly from the mold.

9 Claims, 3 Drawing Sheets

ICE MAKER WITH IMPROVED HARVEST DETECTION AND THERMAL EFFICIENCY

CROSS REFERENCE TO RELATED APPLICATIONS

This is a continuation-in-part of U.S. patent application Ser. No. 09/499,011, entitled "ICE MAKER", filed Feb. 4, 2000, now U.S. Pat. No. 6,223,550 which is a continuation in part of U.S. patent application Ser. No. 09/285,283, entitled "ICE MAKER", filed Apr. 2, 1999, now U.S. Pat. No. 6,082,121.

BACKGROUND OF THE INVENTION

1. Field of the Invention

The present invention relates to freezer units, and, more particularly, to automatic ice makers within such freezer units.

2. Description of the Related Art

The freezer portion of a refrigeration/freezer appliance often includes an ice cube maker which dispenses the ice cubes into a dispenser tray. A mold has a series of cavities, each of which is filled with water. The air surrounding the mold is cooled to a temperature below freezing so that each cavity forms an individual ice cube. As the water freezes, the ice cubes become bonded to the inner surfaces of the mold cavities.

In order to remove an ice cube from its mold cavity, it is first necessary to break the bond that forms during the freezing process between the ice cube and the inner surface of the mold cavity. In order to break the bond, it is known to heat the mold cavity, thereby melting the ice contacting the mold cavity on the outermost portion of the cube. The ice cube can then be scooped out or otherwise mechanically removed from the mold cavity and placed in the dispenser tray. A problem is that, since the mold cavity is heated and must be cooled down again, the time required to freeze the water is lengthened.

Another problem is that the heating of the mold increases the operational costs of the ice maker by consuming electrical power. Further, this heating must be offset with additional refrigeration in order to maintain a freezing ambient temperature, thereby consuming additional power. This is especially troublesome in view of government mandates which require freezers to increase their efficiency.

Yet another problem is that, since the mold cavity is heated, the water at the top, middle of the mold cavity freezes first and the freezing continues in outward directions. In this freezing process, the boundary between the ice and the water tends to push impurities to the outside of the cube. Thus, the impurities become highly visible on the outside of the cube and cause the cube to have an unappealing appearance. Also, the impurities tend to plate out or build up on the mold wall, thereby making ice cube removal more difficult.

A further problem is that vaporization of the water in the mold cavities causes frost to form on the walls of the freezer. More particularly, in a phenomenon termed "vapor flashing", vaporization occurs during the melting of the bond between the ice and the mold cavity. Moreover, vaporization adds to the latent load or the water removal load of the refrigerator.

Yet another problem is that the ice cube must be substantially completely frozen before it is capable of withstanding the stresses imparted by the melting and removal processes. This limits the throughput capacity of the ice maker.

What is needed in the art is an ice maker which does not require heat in order to remove ice cubes from their cavities, has an increased throughput capacity, allows less evaporation of water within the freezer, eases the separation of the ice cubes from the auger and does not push impurities to the outer surfaces of the ice cubes.

SUMMARY OF THE INVENTION

The present invention provides an ice maker within a freezer unit having a heat transfer member which is monolithically formed with and extends from an auger for improved thermal efficiency. The ice maker is also provided with a temperature sensor in a side wall of the mold for detecting an optimum harvest time for the ice cube.

The invention comprises, in one form thereof, an ice maker including a mold having at least one cavity configured for containing water therein for freezing into ice. An auger extends substantially vertically through the at least one mold cavity. The auger is configured for rotating to thereby push the ice out of the at least one mold cavity. A temperature sensor is positioned in association with the mold for sensing a temperature of the mold.

The invention comprises, in another form thereof, an ice maker including a mold having a plurality of side walls defining at least one cavity configured for containing water therein for freezing into ice. An auger extends substantially vertically through the at least one mold cavity. The auger is configured for rotating to thereby push the ice out of the at least one mold cavity. A heat transfer member is metallurgically coupled with the auger and extends downwardly away from the mold.

An advantage of the present invention is that the heat transfer member extending from the auger allows the water to cool faster and thereby provides a higher throughput rate for the ice maker.

Another advantage is that a temperature sensor is positioned in an opening of the mold side wall, thereby allowing detection of the temperature of the water or ice within the mold cavity.

Yet another advantage is that the temperature sensor is spring biased against an end of the opening in the mold side wall to ensure good thermal contact with the mold side wall.

A further advantage is that the heat transfer member may be formed with a plurality of generally concentrically positioned disc-shaped cooling fins which allow the heat transfer member to rotate with the auger during use while at the same time providing an increased surface area for improved thermal efficiency.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
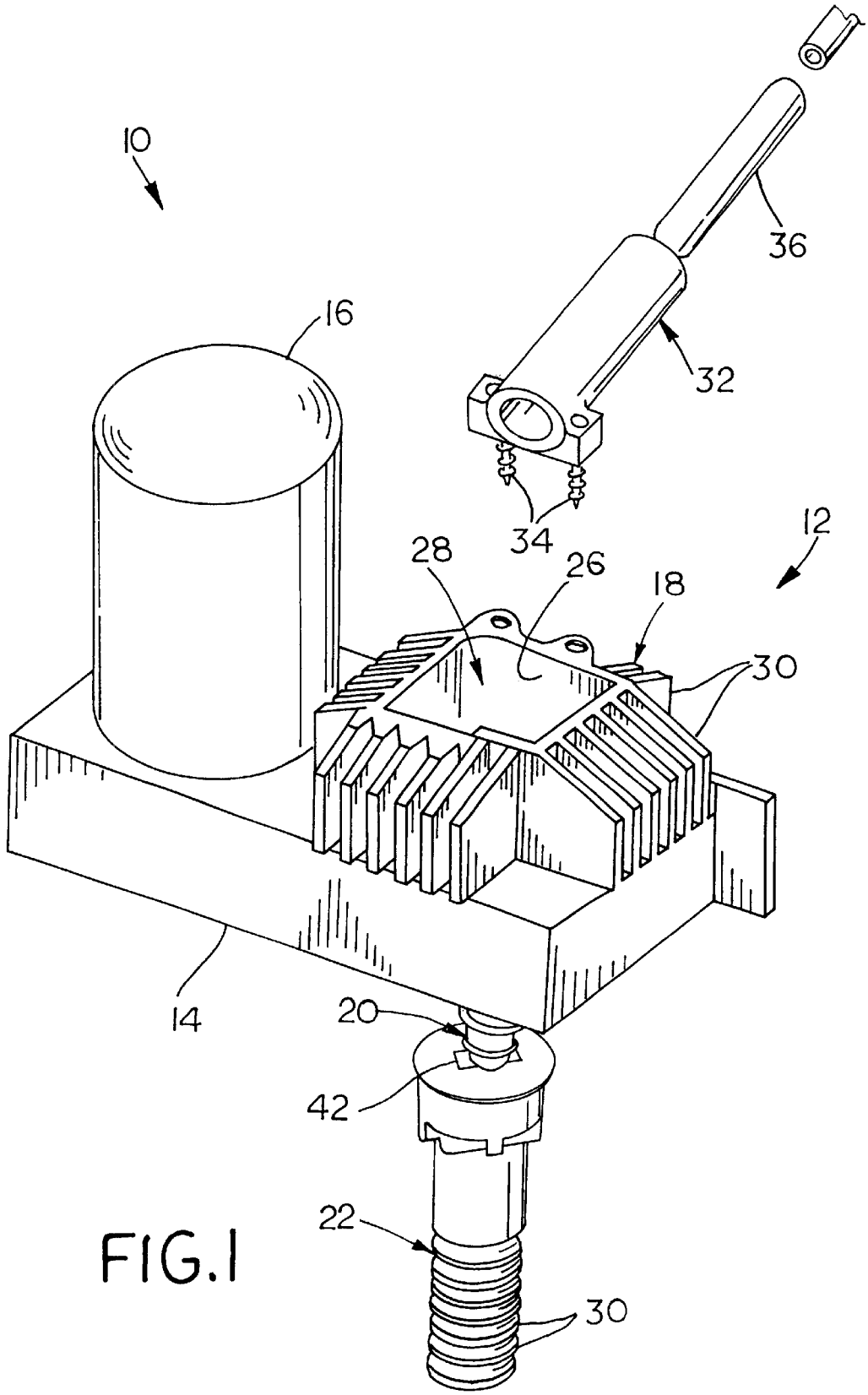
FIG. 1 is a partially schematic, perspective view of a freezer unit including an embodiment of an ice maker of the present invention.
Figure 2:
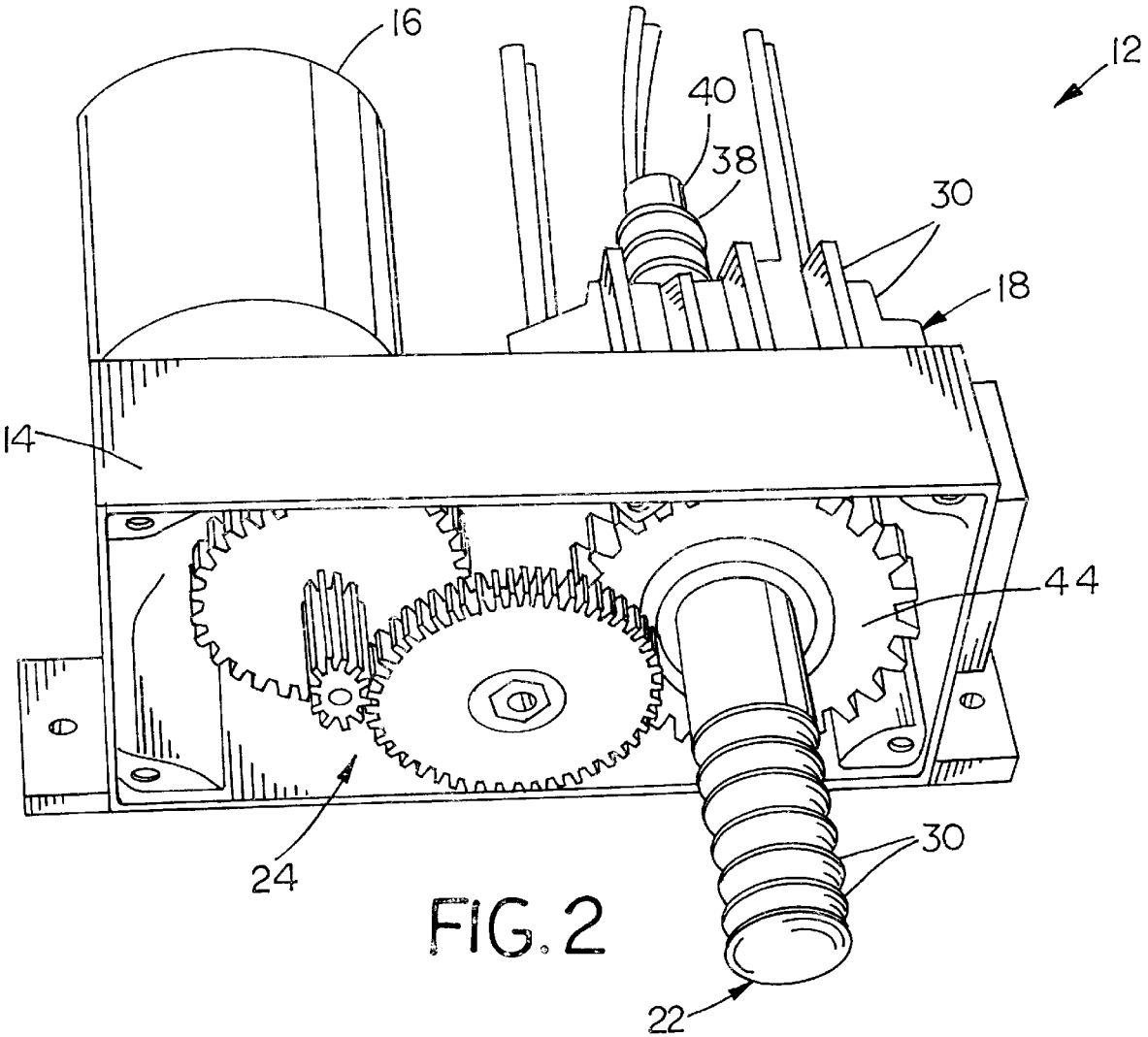
FIG. 2 is another perspective view of the ice maker shown in FIG. 1.

Referring now to the drawings, and more particularly to FIGS. 1 and 2, there is shown an embodiment of a freezer unit 10 within a freezer (not numbered). Freezer unit 10 includes an ice maker 12, which in turn generally includes a housing 14, drive motor 16, mold 18, auger 20, heat transfer member 22 and drive train 24.

Mold 18 includes a plurality of side walls 26 defining a mold cavity 28. Mold cavity 28 is configured for containing water therein for freezing into ice. Mold 18 includes a plurality of cooling fins 30 associated with each side wall 26. Cooling fins 30 provide an increased surface area allowing the water to be frozen into ice at a faster cooling rate within mold cavity 28. Mold 18 is carried by housing 14.

Fill tube 32 is coupled with and carried by mold 18 using threaded fasteners 34. The mating surfaces between fill tube 32 and mold 18, as well as the use of fasteners 34, locate the discharge end of fill tube 32 relative to mold cavity 28 such that water is discharged at a particular impingement angle relative to one or more of side walls 26 of mold 18. Fill tube 32 includes a heater 36 which may be actuated using a controller (not shown) to periodically or continuously maintain fill tube 32 in an unfrozen or unclogged state. For details of the general operating principals of a heated fill tube which may be used with a freezer unit such as employed in the present invention, reference is hereby made to co-pending U.S. patent application Ser. No. 09/130,180 entitled "Heater Assembly for a Fluid Conduit with an Internal Heater".

Auger 20 extends substantially vertically through mold cavity 28, with a distal end which extends past mold cavity 28 for the purpose of transporting an ice cube out of mold cavity 28. Auger 20, in the embodiment shown, is a tapered auger having a continuous flighting 38 extending around and carried by shaft 40. Each of flighting 38 and shaft 40 are tapered such that the distal end of auger 20 has a smaller diameter, thereby allowing a harvested ice cube to be more easily separated from auger 20. A shoulder 42 adjacent flighting 38 is positioned within mold cavity 28 to define a portion of the bottom wall of mold cavity 28. Auger 20 also fixedly carries a gear 44 (FIG. 2) allowing geared interconnection with motor 16 via drive train 24. Drive train 24 includes a plurality of gears (not numbered) which are appropriately sized and configured to provide a predetermined gear reduction ratio between motor 16 and auger 20. Motor 16 can of course be sized with an appropriate output power, output rotational speed and input electrical power requirements.

Heat transfer member 22 is metallurgically coupled with auger 20 and extends downwardly away from mold 18. Heat transfer member 22 functions to provide an increased surface area such that the cooling rate of the water within mold cavity 28 is enhanced. More particularly, heat transfer member 22 is monolithically formed with auger 20 to provide a maximum cooling rate to the water within mold cavity 28. If heat transfer member 22 was merely a separate piece which was mechanically coupled to auger 20, surface imperfections, even at the atomic level, would decrease the cooling efficiency of ice maker 12. By monolithically forming heat transfer member 22 with auger 20, heat transfer via conduction away from mold cavity 28 is improved, thereby improving the overall efficiency of ice maker 20.

Although heat transfer member 22 is shown as being monolithically formed with auger 20, it is also possible to metallurgically bond heat transfer member 22 to auger 20 by other techniques, such as welding, brazing, etc. providing continuous conduction without a surface-to-surface interface therebetween.

Because heat transfer member 22 is metallurgically coupled with and thus rigidly affixed to auger 20, heat transfer member 22 rotates with auger 20 during operation. Thus, heat transfer member 22 must be configured with an external shape allowing rotation within freezer unit 10 within described geometric constraints. In the embodiment shown, heat transfer member 22 includes a plurality of generally disc shaped fins 48 which are aligned generally coaxially with each other. More particularly, heat transfer member 22 includes six generally disc shaped fins which are aligned generally coaxially with each other. Fins 48 function to provide an increased surface area to heat transfer member 22, thereby providing an increased heat transfer efficiency to ice maker 12.

Figure 3:
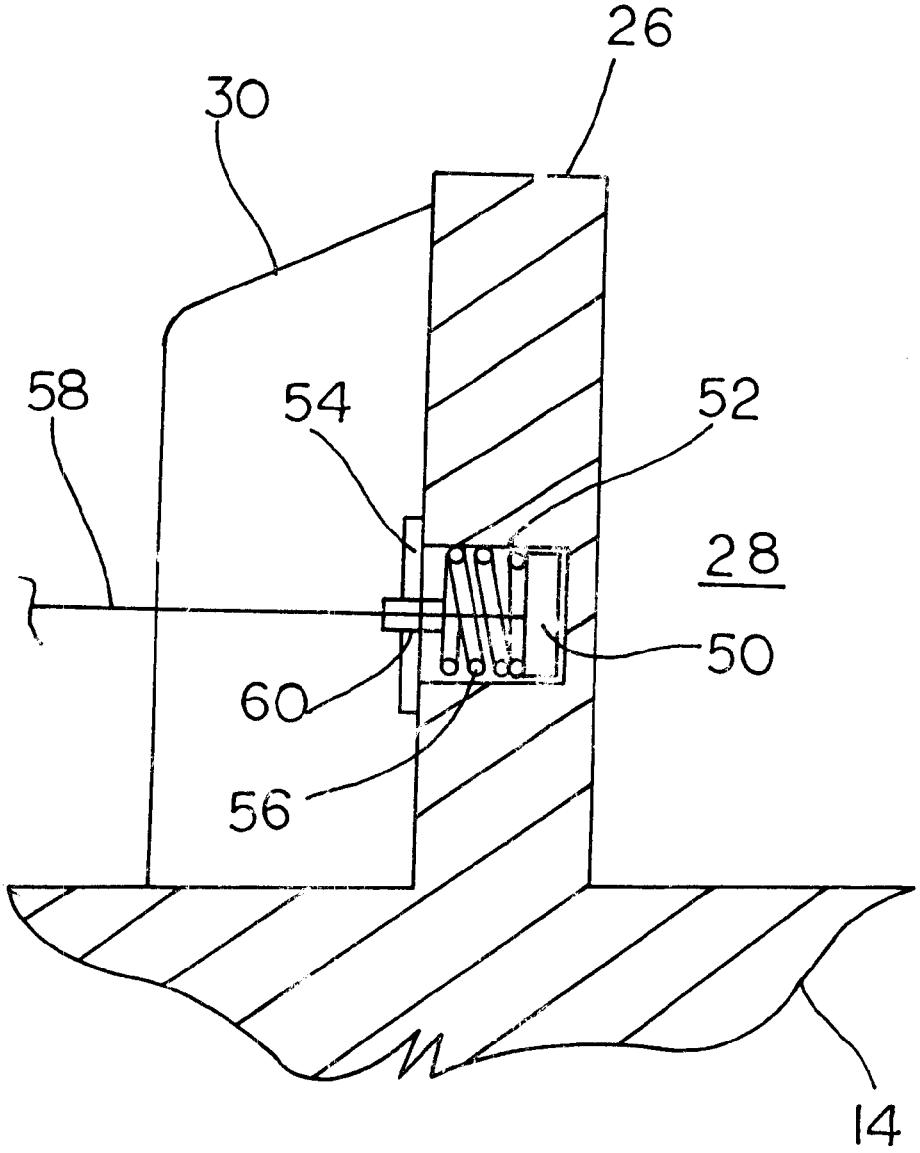
FIG. 3 is a fragmentary, sectional view of a mold side wall with a temperature sensor positioned therein.

Referring now to FIG. 3, there is shown a sectional view of a portion of a side wall 26 of mold 18. A temperature sensor 50 is positioned in association with side wall 26 of mold 18 for sensing a temperature of mold 18. More particularly, side wall 26 includes an opening 52 therein. Temperature sensor 50 is positioned within opening 52 at an end of opening 52 which is closely adjacent to mold cavity 28. Temperature sensor 50 thus may be used to detect the temperature of the water which freezes into ice within mold cavity 28. A closure cap 54 covers an opposite end of opening 52. A resilient member 56 in the form of a compression spring is positioned within opening 52 and biases temperature sensor 50 against the end of opening 52. An electrical conductor 58 is electrically coupled with temperature sensor 50 and passes through compression spring 56 and a hole 60 within closure cap 54. Closure cap 54 may be threadingly engaged with opening 52, press fit within opening 52, etc., depending upon the particular configuration. Temperature sensor 50 may be any suitable sensor for detecting a temperature within mold cavity 28 such as a thermocouple or the like.

During use, water is injected into mold cavity 28 from fill tube 32. Temperature sensor 50 provides an output signal to a controller (not shown) which detects when the ice cube within mold cavity 28 has frozen to a point allowing harvesting thereof The controller actuates motor 16, which in turn drives auger 20 via drive train 24. Since mold cavity 28 has a non-circular cross section, rotational movement of auger 20 causes translational movement of the ice cube out of mold cavity 28. The heat transfer necessary to cool the water to form the ice cube is enhanced by heat transfer member 22 which is monolithically formed with and extends from auger 20 away from housing 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ice maker, comprising:

a mold including a plurality of side walls defining at least one cavity configured for containing water therein for freezing into ice;

an auger extending substantially vertically through said at least one mold cavity, said auger being configured for rotating to thereby push the ice out of said at least one mold cavity; and a heat transfer member metallurgically coupled with said auger and extending downwardly away from said mold.

2. The ice maker of claim 1, wherein said heat transfer member is one of monolithic with and welded to said auger.

3. The ice maker of claim 2, wherein said heat transfer member is monolithic with said auger.

4. The ice maker of claim 1, wherein said heat transfer member comprises a plurality of generally disc shaped fins aligned generally coaxially with each other.

5. The ice maker of claim 4, wherein said heat transfer member comprises at least six generally disc shaped fins aligned generally coaxially with each other.

6. A freezer, comprising:

a freezer unit including an ice maker, said ice maker comprising: a mold including a plurality of side walls defining at least one cavity configured for containing water therein for freezing into ice;

an auger extending substantially vertically through said at least one mold cavity, said auger being configured for rotating to thereby push the ice out of said at least one mold cavity; and a heat transfer member metallurgically coupled with said auger and extending downwardly away from said mold.

7. The freezer of claim 6, wherein said heat transfer member is one of monolithic with and welded to said auger.

8. The freezer of claim 7, wherein said heat transfer member is monolithic with said auger.

9. The freezer of claim 6, wherein said heat transfer member comprises a plurality of generally disc shaped fins aligned generally coaxially with each other.

* * * * *